United States Patent [19]

Burke

[11] 4,240,913

[45] Dec. 23, 1980

[54] WASHER AND HYDRO-EXTRACTORS

[75] Inventor: Anthony B. Burke, Huddersfield, England

[73] Assignee: Thomas Broadbent & Sons Limited, Huddersfield, England

[21] Appl. No.: 41,379

[22] Filed: May 23, 1979

[30] Foreign Application Priority Data

May 26, 1978 [GB] United Kingdom ..... 23343/78

[51] Int. Cl.[3] ..... D06F 23/02; D06F 37/06; B01D 33/36

[52] U.S. Cl. ..... 210/373; 68/24; 68/142; 210/DIG. 2

[58] Field of Search ..... 68/24, 142; 34/58; 210/373, 375, DIG. 2, 380 H, 380 L

[56] References Cited

U.S. PATENT DOCUMENTS

| | | | |
|---|---|---|---|
| 2,867,106 | 1/1959 | Stone, Jr. et al. | 68/24 |
| 2,867,107 | 1/1959 | Brown | 68/24 |

FOREIGN PATENT DOCUMENTS

| | | | |
|---|---|---|---|
| 1292119 | 4/1969 | Fed. Rep. of Germany | 68/24 |

*Primary Examiner*—Philip R. Coe

*Attorney, Agent, or Firm*—Beveridge, DeGrandi, Kline & Lunsford

[57] ABSTRACT

A washer or hydro-extractor comprising a cylindrical basket adapted to be rotated about its longitudinal axis for liquid extracting operations on wet material placed therein. A plurality of rigid flaps within the basket are selectably pivotable about respective axes extending longitudinally of the basket. The flaps normally lie substantially flat against the inner cylindrical surface of the basket. A respective cam follower is rigidly coupled to each flap via a respective crank arm. In order to selectably pivot the flaps for stripping caked material from the inner surface of the basket, a stripper cam is selectably displaceable into a position in which it engages the cam followers of those flaps which, at any instant during stripping, lie in what is, at that time, the upper part of the basket, whereby the latter flaps are pivoted from their normal positions for effecting stripping.

4 Claims, 5 Drawing Figures

WASHER AND HYDRO-EXTRACTORS

DESCRIPTION

The present invention relates to washer extractors and hydro-extractors of the centrifugal type in which a load of laundry is rotated at high speed in a perforated basket for the purpose of extracting liquid from the laundry by centrifugal force.

After high speed extraction of liquid (normally water) from a load of laundry in a cylindrical rotary basket, the load tends to form a solid "cake" on the inside wall of the basket which will usually not collapse under its own weight. The load has therefore to be stripped off the basket wall by some means.

Various devices have been proposed previously for stripping caked material from the basket wall after high speed extraction of liquid. For example, it is known to employ a plurality of resilient members which are arranged to project inwardly from the internal surface of the basket during slow speed rotation of the basket but which are deformed under the centrifugal force on the materials in the basket at high rotational speeds whereby the resilient members lie substantially flat against the basket wall. When the speed of rotation is reduced after a high speed extraction operation, the resilient members regain their original shape so as to break-up the cake formed within the basket. Another known arrangement employs a plurality of movable grids having substantial mass. The grids have portions which project into the basket to a greater or lesser extent depending upon the rotary position of the basket. When the basket rotates at low speeds, those projecting portions in the upper part of the basket extend further into the basket than those in the lower part whereby to break up the cake on the basket interior. The displacement of the grids is, however, effected solely by the gravitational force acting on them.

Neither of these latter means can, however, be relied upon in practice since the resilient force in the first case and the gravitational force in the second case may be insufficient to overcome the rigidity of the cake resulting from centrifuging.

It is an objective of the present invention to provide a more positive means of dislodging materials caked on the internal surface of the drum which does not rely on gravity or on the stored energy of deformed resilient members.

In accordance with the present invention, there is provided a washer or hydro-extractor comprising a cylindrical basket adapted to be rotated about its longitudinal axis for liquid extracting operations on wet material placed therein, and a plurality of rigid flaps within the basket which are adapted normally to lie substantially flat against the inner cylindrical surface of the basket, but which are selectably pivotable about respective axes extending longitudinally of the basket for stripping caked material from said inner surface of the basket.

Preferably, in order to reduce the possibility of loosened materials becoming trapped behind the flaps, at any instant during stripping, only those flaps which lie in what is, at that time, the upper part of the basket are pivoted to perform stripping, the flaps which lie in what is, at that time, the lower part of the basket occupying their positions in which they lie substantially flat against the basket cylindrical inner surface.

The invention is described further hereinafter, by way of example, with reference to the accompanying drawings, in which.

Figure 1:
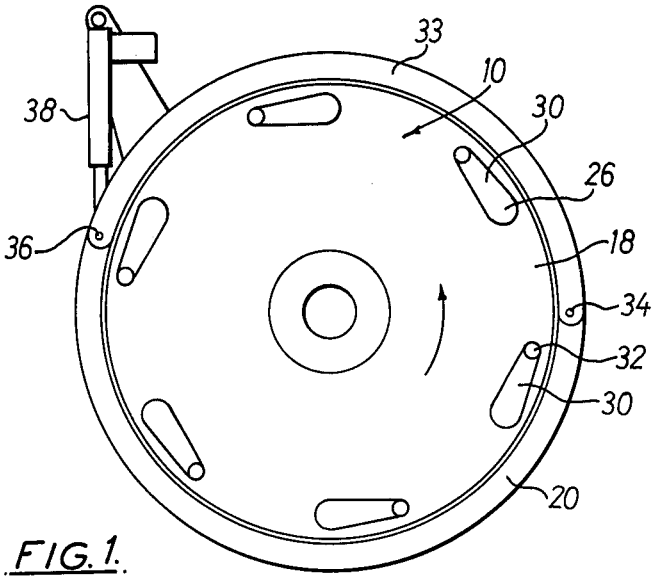
FIG. 1 is a diagrammatic rear view of an extractor in accordance with the present invention embodying a load stripping mechanism, viewed from the rear and with the stripping mechanism de-actuated.

The extractor illustrated diagrammatically in the drawings comprises a basket 10 having an open mouth 12 (see FIG. 5) for the insertion and removal of loads of laundry. The interior of the basket 10 is defined by an annular, radially extending front wall 14 (FIG. 5), a cylindrical side wall 16 and a circular, radially extending rear or base wall 18, (omitted from FIG. 5 for clarity), the cylindrical side wall being perforated to allow centrifuged liquid to pass therethrough during operation of the extractor. The closed rear wall 18 is coupled to a shaft (not shown) whereby the basket can be rotated about its longitudinal axis by means of a drive motor (again not shown), the longitudinal axis being arranged to lie, in this embodiment, in a horizontal plane. The basket 10 rotates within a stationary outer cylindrical casing 20 (not shown in FIG. 5).

Within the basket 10 lie a plurality (six in this embodiment) of rigid flaps 22 which are mounted on pivots 24 for privotal movement about respective axes 26 extending in directions parallel to the basket longitudinal axis. In their de-actuated state (FIGS. 1 and 2), the flaps 22 are arranged to be spring biassed, for example by respective torsion springs (not shown), so as to lie substantially flat against the internal cylindrical surface 28 of the basket as shown in FIG. 2. For this purpose, it will be noted from FIG. 2 that the flaps are preferably curved to conform generally to the shape of the basket. The flaps 22 extend through the whole length of the basket, the pivots 24 at each end of the flaps extending through the front 12 and back 18 walls of the basket. The front pivots 24 embody the torsion springs and the rear pivots 24 extend through the rear wall 18 where they are attached to respective crank arms 30 on the free end of each of which there is a roller 32 serving as a cam-follower. Each flap 22 and its associated crank arm 30 thus forms a rigid assembly.

Figure 2:
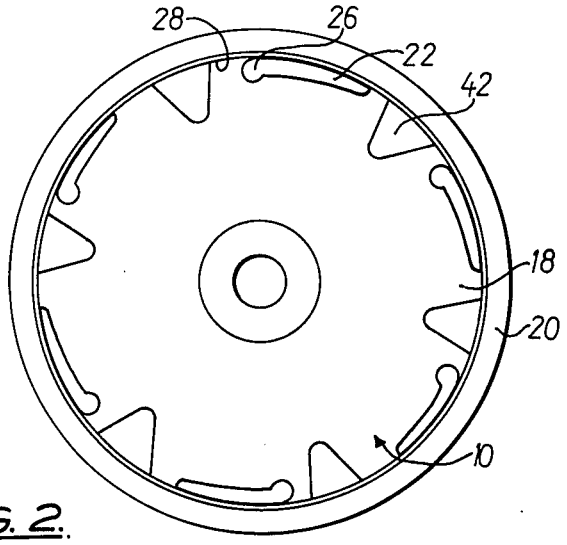
FIG. 2 is a diagrammatic front view of the extractor of FIG. 1 with the stripping mechanism de-actuated.

Disposed in the radial plane containing the rollers 32 is a rigid, curved, stripper cam 33, which is preferably arcuate, this cam being pivoted at one end, for example to the stationary outer casing 20, at a location indicated by the reference numeral 34 whereby the cam 33 normally lies in line with the rear end of the outer casing during rotation of the basket 10 for extraction purposes, as shown in FIG. 1. The other end of the cam 33 is pivotably connected at 36 to a ram 38 by means of which the cam 33 can be selectably displaced so as to adopt the position illustrated in FIGS. 3 and 5.

Figure 3:
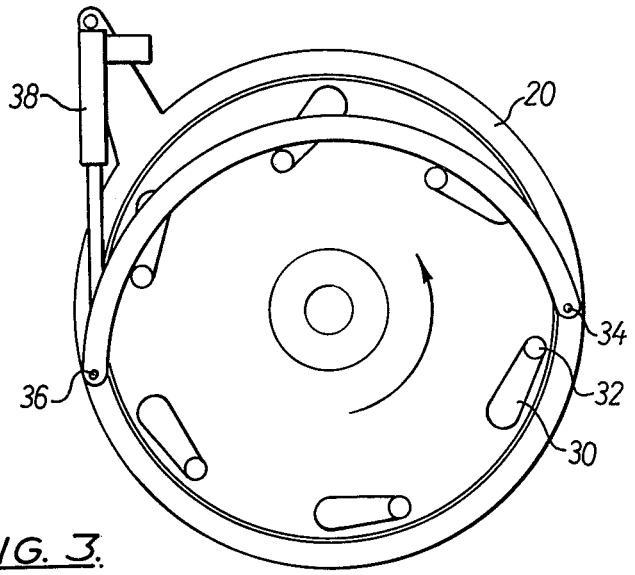
FIG. 3 is a diagrammatic rear view of the extractor of FIGS. 1 and 2 with the stripping mechanism actuated.
Figure 4:
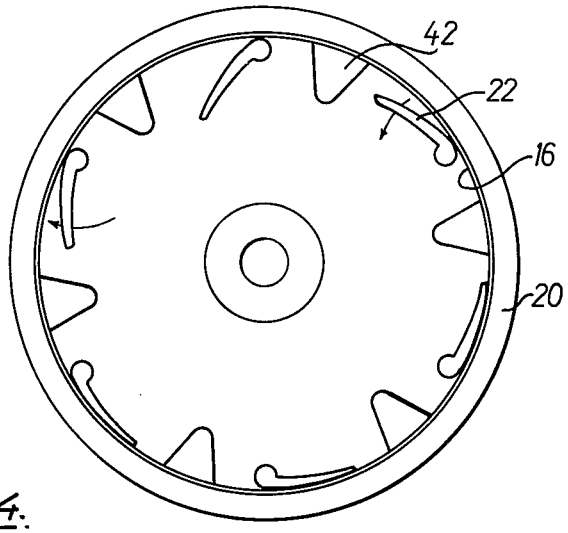
FIG.4 is a diagrammatic front view of the extractor of FIGS. 1 to 3, with the stripping mechanism actuated.
Figure 5:
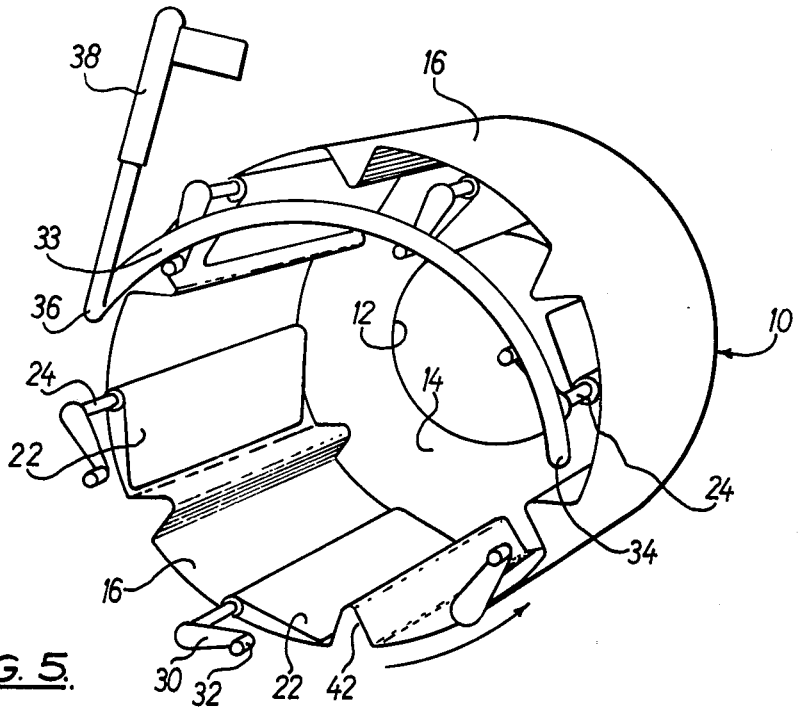
FIG. 5 is a diagrammatic perspective view from the rear of the extractor of FIGS. 1 to 4 with the stripping mechanism actuated.

During washing and/or extraction, the ram 38 remains de-actuated and the flaps 22 still lie against the internal cylindrical wall surface 28 of the basket by virtue of the combined action of the torsion springs and centrifugal force. After extraction, when stripping of the "caked" load from the basket is required, the ram 38 is actuated while the basket is rotated slowly, for example anti-clockwise as viewed from the rear (FIGS. 1, 3 and 5). With the cam 33 then in the position shown in FIGS. 3 and 5, the rollers 32 engage and ride up the cam 33 at approximately the 3 o'clock position as viewed in FIG. 3 thereby imparting an angular displacement to the flaps 22 via the crank arms 30 and rear pivots 24 which is a maximum at the 12 o'clock position. The displaced flaps 22 force the load away from the basket wall 28, breaking the "cake" formation and enabling the load to collapse to the lower region of the basket. When the rollers 32 have passed the 12 o'clock position, the torsion springs hold them against the cam 33 so that by the 9 o'clock position the flaps have returned to their normal disposition which they then occupy until the next time they reach the 3 o'clock position when the displacement is repeated.

Thus the stripper cam in its activated position engages only the cam followers of those flaps which, at any instant during stripping, lie in what is, at that time, the upper part of the basket, i.e. the part lying above the horizontal diameter of the basket, whereby the latter flaps are pivoted from their normal positions for stripping caked material from the inner surface of the basket.

It will be appreciated that the displacement of the flaps only when occupying an upper position relative to the prevailing lowest part of the basket obviates trapping of the collapsed load since this falls onto flaps which lie firmly against the basket wall.

As shown in the drawings, longitudinally extending, inwardly directed ribs 42 are preferably provided within the basket in a conventional manner to assist the efficient operation of the basket.

I claim:

1. In a washer or hydro-extractor having a cylindrical basket adapted to be rotated about its longitudinal axis for liquid extracting operations on wet material placed therein, the improvement comprising a plurality of rigid flaps within the basket which are selectably pivotable about respective axes extending longitudinally of the basket, the flaps being adapted normally to lie substantially flat against the inner cylindrical surface of the basket, a respective cam follower rigidly coupled to each flap, an arcuate stripper cam pivotably attached at its one end to a fixed point, and means for pivotably displacing the stripper cam into a position in which its concave surface engages the cam followers of those flaps which, at any instant during stripping, lie in what is, at that time, the upper part of the basket whereby the latter flaps are pivoted from their normal positions for stripping caked material from said inner surface of the basket.

2. A washer or hydro-extractor according to claim 1 in which said stripper cam displacing means comprises a ram pivotably connected to the other end of the stripper cam.

3. A washer or hydro extractor according to claim 1 or 2 in which the flaps comprise generally rectangular plates, and pivots projecting from each end of said plates which extend through front and rear walls of the basket, respectively, for pivotably mounting the flaps.

4. In a washer or hydro-extractor having a cylindrical basket adapted to be rotated about its longitudinal axis for liquid extracting operations on wet material placed therein, the improvement comprising a plurality of rigid flaps within the basket which are selectably pivotable about respective axes extending longitudinally of the basket, the flaps being adapted normally to lie substantially flat against the inner cylindrical surface of the basket, a respective cam follower rigidly coupled to each flap, an arcuate stripper cam pivotably attached at its one end to a fixed point, and means for pivotably displacing the stripper cam into a position in which its concave surface engages the cam followers whereby the flaps are pivoted from their normal positions for stripping caked material from said inner surface of the basket.

* * * * *